US005664399A

United States Patent [19]

Cassou

[11] Patent Number: 5,664,399

[45] Date of Patent: Sep. 9, 1997

[54] TILTABLE TABLE FOR PACKAGING LIQUIDS, PARTICULARLY ANIMAL SEMEN, IN FLEXIBLE ARTIFICIAL INSEMINATION POUCHES

[75] Inventor: Bertrand Cassou, L'Aigle, France

[73] Assignee: Societe IMV -Instruments de Medecine Veterinaire, L'Aigle, France

[21] Appl. No.: 591,480

[22] PCT Filed: May 4, 1995

[86] PCT No.: PCT/FR95/00582

§ 371 Date: Feb. 21, 1996

§ 102(e) Date: Feb. 21, 1996

[87] PCT Pub. No.: WO95/30579

PCT Pub. Date: Nov. 16, 1995

[30] Foreign Application Priority Data

May 9, 1994 [FR] France ..... 94 05661

[51] Int. Cl.[6] ..... B65B 3/06; B65B 43/12; B65B 67/12; A61D 19/02

[52] U.S. Cl. ..... 53/284.7; 53/374.9; 53/390; 141/114; 141/313

[58] Field of Search ..... 141/10, 114, 313, 141/316, 23, 24; 53/455, 469, 458, 390, 284.7

[56] References Cited

U.S. PATENT DOCUMENTS

| | | | |
|---|---|---|---|
| 3,930,350 | 1/1976 | Reid . | |
| 3,938,299 | 2/1976 | Lerner | 53/469 X |
| 4,278,198 | 7/1981 | Norton et al. . | |
| 4,512,136 | 4/1985 | Christine | 53/455 X |
| 4,709,534 | 12/1987 | Sengewald . | |
| 4,887,913 | 12/1989 | Sengewald . | |
| 4,893,453 | 1/1990 | Weikert | 53/469 |
| 5,357,733 | 10/1994 | Weikert | 141/10 X |
| 5,493,845 | 2/1996 | Adolf et al. | 53/455 X |

FOREIGN PATENT DOCUMENTS

| | | |
|---|---|---|
| 0 096 191 | 12/1983 | European Pat. Off. . |
| 2 450 688 | 10/1980 | France . |
| 2 667 504 | 4/1992 | France . |
| 2 667 782 | 4/1992 | France . |

*Primary Examiner*—Horace M. Culver
*Attorney, Agent, or Firm*—Young & Thompson

[57] ABSTRACT

A device for packaging liquids, particularly animal semen, in pre-scaled and pre-cut pouches provided in a roll and designed for artificial insemination. The device includes a tiltable table with a base enabling adjustment of the tilt angle of the table to facilitate gravitational filling of pouches, a pouch filling station and a sealing station. The device also includes a movable filling needle inserted into a removable needle guide and mounted on a block that includes an inductive proximity sensor for generating an alternating magnetic field which is automatically stopped when a metal liner is inserted into the needle guide following needle insertion into the pouch. Cessation of the alternating magnetic field triggers the sealing of the pouch.

13 Claims, 2 Drawing Sheets

Figure 1:
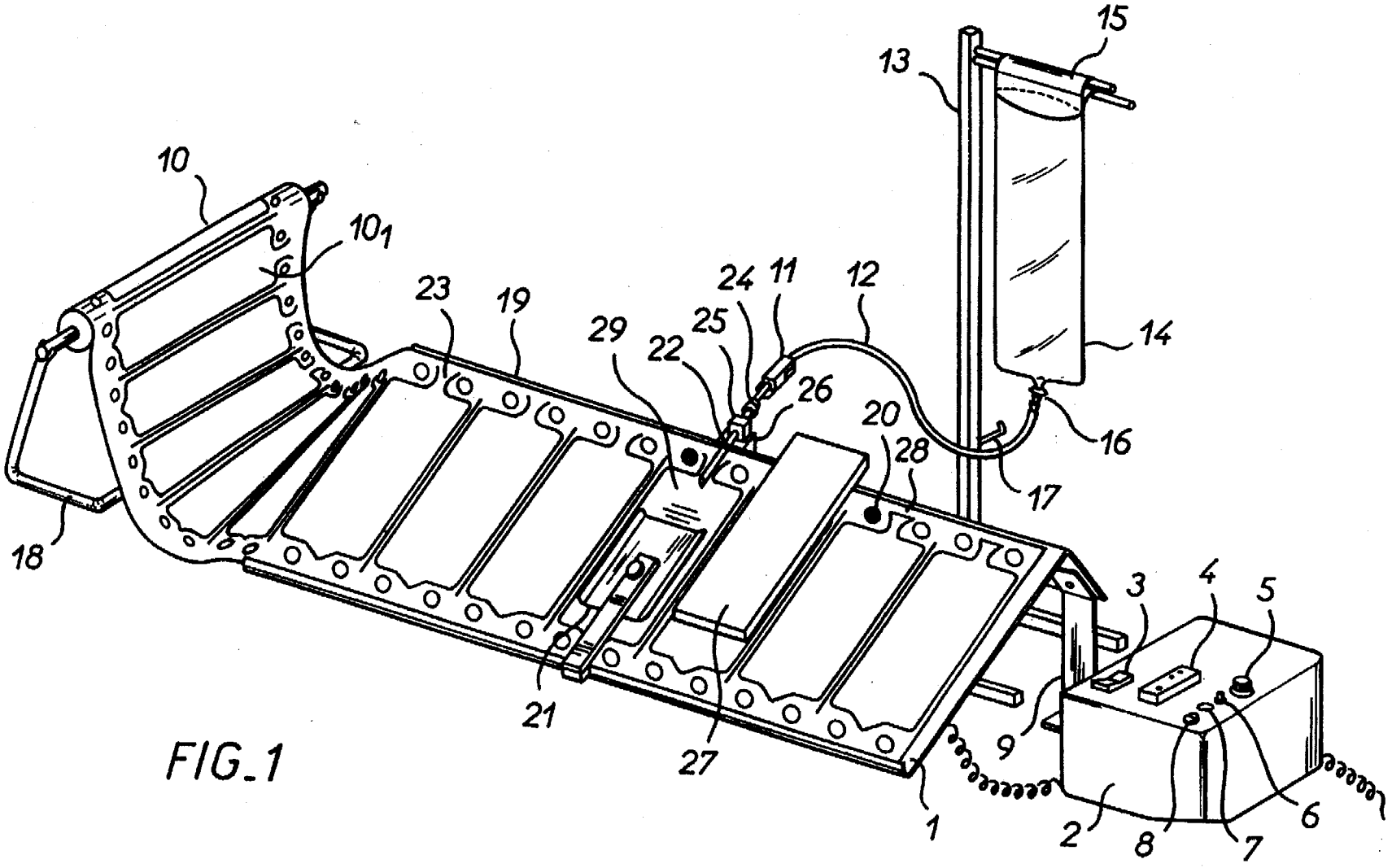

TILTABLE TABLE FOR PACKAGING LIQUIDS, PARTICULARLY ANIMAL SEMEN, IN FLEXIBLE ARTIFICIAL INSEMINATION POUCHES

The present invention concerns a device for the packaging of liquids, more particularly animal semen, and especially boar semen, in flexible pouches intended for artificial insemination and described in particular by the applicants in their French patent 2667504 of Oct. 9, 1990.

To improve the packaging processes of animal semen, the applicants have formed pouches, referred to as dose-pouches packed in the form of a two-layer film roll containing pouches in the form of pre-cut and pre-welded sachets, and a fully automated machine described more particularly in the aforementioned patent for filling, welding and printing said pouches. While offering full satisfaction concerning its general conditions of operation, this machine is more particularly suited to large semen production centers selling doses of semen to major breeders.

For independent breeders having between 300 and 1000 sows to be inseminated and who have not used semen production centers because they use their own boars at the farm, they have neither the utility nor more often than not the financial capability of acquiring such a machine despite all the advantages it offers. In general, it is known that breeders who collect the boar semen at the farm, pack the semen in plastic bottles provided with a screw-on cap. The use of such bottles includes many drawbacks because their cost is relatively high and the multitude of manual manipulations they generate is costly. In addition, the bottles are supplied in bulk and are either in permanent contact with more or less polluted air liable to degrade the quality of the animal semen, thus causing a drop in fertility or risks of contamination within the animal's uterus. Because of their packaging mode, the use of dose pouches eliminates such drawbacks.

It will therefore be seen that the current situation does not facilitate the task of the breeder who collects semen more particularly from boars on the farm and who is unable to use flexible insemination pouches to pack the semen, in particular from the boars.

Therefore, the invention is more specifically designed to eliminate such drawbacks and is specially tailored to the needs and financial means and to the concerns of breeders who collect the boar semen more particularly at the farm and who do not have a sufficiently high number of sows to justify the purchase of an automatic dose pouch packaging machine.

According to the first characteristic of the invention, it is designed for the packaging of liquids and more particularly animal semen, in particular boar semen, in flexible pouches designed for artificial insemination, appearing in the form of a roll of pre-cut bags, pre-perforated and pre-welded, characterized in that it comprises a table provided with tilting means, at least one positioning element at the filling station and/or at the welding station more particularly, designed to hold the pouches correctly, a needle guide forming a device guiding the mobile filling needle so that it is stable and therefore always remains inserted between the two lips of the pouch film and is also constantly in the filling axis, a volume calibrating pallet, a mobile weighted welding pallet connected to an electric supply box upon it and which, by the pressure it applies to the pouch, varying according to the thickness of the pouch film, welds the pouch.

According to other characteristics:

the means of maintaining the table tilted comprise two adjustable feet located respectively at the left and right ends of the table on the side of the positioning element so that the operator can modify the angle of tilt and thus facilitate the filling of the flexible insemination pouches. In addition, these adjustable feet have a suction device designed to provide total stability of the invention during its use and in particular;

the means of positioning comprising at least one, but preferably two positioning studs located at the filling station and/or at the welding station to provide excellent retention and total stability of the pouches during filling then welding operations and, in addition, identification by the affixing of a label to the pouch;

an electric box with an on/off switch, a time delay for adjusting the flexible pouch welding time, a potentiometer for adjusting the welding station heating power and a manual welding test device for checking whether the flexible pouch welding system is operating correctly before the pouch is filled and welded under real working conditions;

the needle guide is removable and attached to the block comprising an inductive proximity detector emitting an AC magnetic field which cuts off automatically as soon as a metal fitting placed upstream of the needle guide, and mobile axially with respect to that guide, is inserted in the needle guide following the insertion of the filling needle into the filling conduit of the pouch, triggering the welding of the flexible insemination pouch that the operator has previously moved in front of the welding station once filling is complete;

said needle guide is of NYLON and connected to the table by removable attaching means so that it can be cleaned or replaced by the user whenever he conditions a new batch, thus avoiding any mixture between animal breeds;

the mobile metal sleeve is also removable for maintenance and is manually fitted into the needle guide providing more particularly the connection, and therefore the retention, of the supply pipe and the filling needle;

the volume calibrating pallet is attached to the lower edge of the table so as to provide adjustment to within 2 ml of the volume of liquid desired by checking the space between the surface of the tilting table and said pallet;

on the filling station there is a graduation element consisting of a visual marker guaranteeing a more accurate volume during the filling of the pouch;

the welding pallet is mobile and connected by a hinge to the upper edge of the table to provide for the free circulation of empty or full pouches and apply sufficient pressure to control the quality of the weld as a function of the thickness of the film forming the flexible pouch;

the mobile welding pallet includes a flat heating filament below an interchangeable strip of TEFLON provided with an adhesive surface.

The device also has the characteristic of including:

a boom from which a recipient with a pierced bottle may be hung alone, or within which the user will place a dilution pouch containing the liquid medium to be packed in the flexible insemination pouches, or the dilution bag directly and alone;

a reel on which the roll of flexible insemination pouches will stand.

Thus, the invention proposes a simple and efficient means of preserving animal semen thanks more particularly to the use of a tilting stainless steel table on which the operator will manually run the roll of flexible insemination pouches designed to contain the animal semen and may in addition and at any time, be provided with full visual control of the various work-stations covered by the description that follows, given as an example with respect to the attached drawings, illustrating:

FIG. 1 a perspective view of the invention in the utilization position in its initial production configuration.

Figure 2:
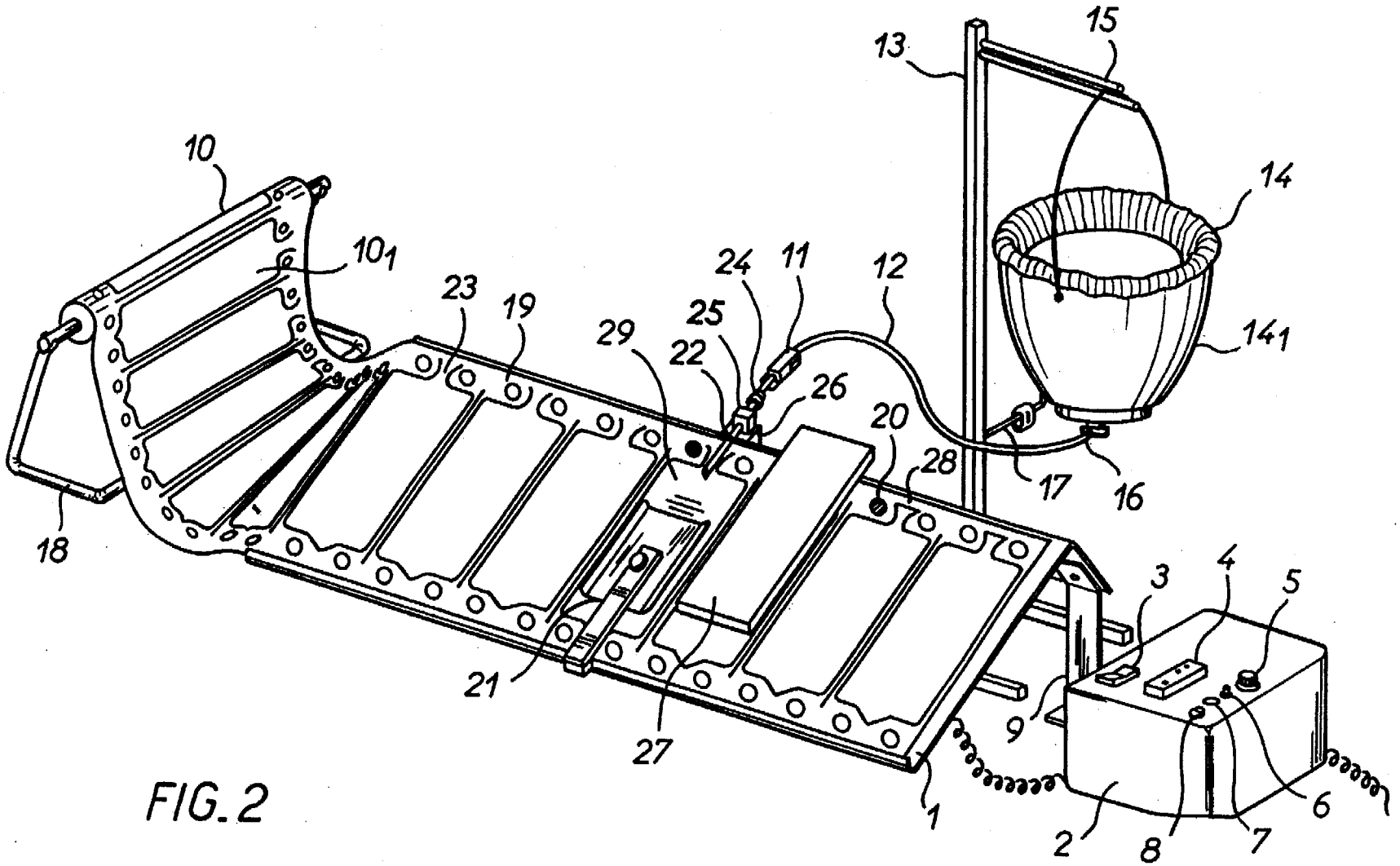

FIG. 2 a perspective view of the invention in the utilization position according to its second utilization configuration.

The characteristics and advantages of the invention are evident from this description.

The tiltable table (1) is connected to an electronic unit (2) generally placed near the second end of the invention. This electrical connection system is essential for the invention to operate.

The electronic unit (2) includes various elements all of which play a clearly determined role:

an on/off switch (3), a time-out (4) designed to adjust the welding duration of the flexible pouch ($10_1$), a potentiometer (5) controlling the heating power of the welding station, a manual weld test (6) giving the operator the possibility of checking whether the system welding the dose pouches ($10_1$) is operating correctly before the pouch is filled or welded under real working conditions, a weld indicator lamp (7) which lights up during the welding time, a fuse (8) protecting all the vital parts of the electrical installation.

The device includes more particularly a table (1) provided with means of holding it in a tilted position to facilitate gravity filling of the pouches ($10_1$). Said means of retention comprise two adjustable feet (9) located respectively at the left and right ends of table (1) on the side of the positioning element so that the operator can choose the angle of tilt of the table (1) by adjusting the position of the two adjustable feet (9).

A suction attachment beneath each of the adjustable feet (9) prevents the invention from sliding during manipulation in particular.

The variable tilt angle of the table (1) ensures better flow for some liquid media designed to be preserved in the pouches ($10_1$) which, in the present case, appear in the form of a roll (10) so as to reduce any risks of the abrupt arrival of liquid in the pouch ($10_1$) and therefore, risks of the semen flowing back out of the pouch ($10_1$).

The risks of the semen flowing back out of the pouch ($10_1$) are also attenuated by a manual system controlling the volume of the dose of semen.

Indeed, the volume of the dose of semen to be added to the pouch ($10_1$) is checked by the amount of pressure applied on a clamp (11). Accordingly, the user must operate the clamp to tighten the feed pipe (12) when the level of liquid reaches the desired volume. The liquid will stop circulating instantly as the operator uses this clamp to prevent any drip feed phenomenon and therefore any loss of semen and the soiling or overflow of the liquid when the filling needle (22) is removed after the pouch ($10_1$) has been filled. The operator will therefore use this clamp (11) both to allow the liquid to circulate and to retain it.

As the flexible insemination pouch ($10_1$) is transparent, a graduation (29) providing a visual reference will appear on the table at the filling station so that the operator may visually check the amount of liquid to be allowed into said pouch ($10_1$). This visual reference will guarantee a more accurate volume during the filling of pouch ($10_1$).

The device comprising a table for filling the pouches ($10_1$), tilted so that the liquid may flow along the wall of said pouches, will also prevent any oxygenation and accordingly, any considerable production of air bubbles, habitually observed during the filling of the pouches will certain substances, in particular animal semen such as that of the boar.

This tiltable table system (1) allows the pouch to be filled by gravity. The liquid entering the pouch is therefore fed directly to the bottom of said pouch to prevent any formation of liquid residue at the weld point which could perturb the trouble-free operation of the welding system.

The tiltable table (1) offers a wide flat and smooth surface so that the operator can easily pull through the roll of flexible insemination pouches (10), eliminating any risk of catching and therefore piercing the plastic film. In addition, the upper edge of the table (1) facilitates a simple, rectilinear and low cost layout for the various work-stations.

The device consists of a boom (13) generally placed near the invention so that any pouches of dilution (14) containing the liquid to be preserved in the dose pouches ($10_1$) may be suspended vertically.

The dilution pouch (14) will be suspended either directly from boom (13) by a clamp (15) (FIG. 1) or inserted in a recipient ($14_1$) (FIG. 2). The use of the dilution pouch (14) is, however, optional because the user may choose to use the recipient ($14_1$) alone.

The bottom of the dilution pouch (14) whether suspended from the boom (13) (FIG. 1) or placed inside recipient ($14_1$) (FIG. 2) and the bottom of recipient ($14_1$) are pierced to allow the insertion of a feed pipe (12) of flexible plastic material through which the liquid will circulate. A sealing connection (16) will connect the feed pipe (12) to the dilution pouch (14).

The boom (13) also includes a "dilution" support (17) so that the operator may, if necessary, suspend another pouch in which he has prepared a liquid substance more particularly intended for preservation in the aforementioned pouches ($10_1$).

A roll of flexible insemination pouches (10) rests upon a reel (18) placed in parallel to the invention. The reel (18) makes it easier to align the pouches ($10_1$) at the various work-stations, i.e. at the filling stations, welding and if necessary pouch identification stations ($10_1$) by the affixing of a label, if necessary.

The movement of this twin layer film roll (10) which aligns pouches in the form of pre-cut and pre-welded pouches, takes place manually. Therefore, the operator runs the roll of pouches (10) by sliding it from left to right. Using both hands, the operator holds the film containing the pouches ($10_1$) so as to circulate successively pouch ($10_1$) by pouch ($10_1$) in front of the filling station, then the welding station and finally the pouch identification station ($10_1$) if used, by the affixing of a label.

To facilitate positioning on the invention of the roll of pouches (10) designed more particularly to contain animal semen, in particular that of the boar, pouches ($10_1$) include respectively at each of their two ends, i.e. on either side of the filling channel (23) of pouch ($10_1$), two positioning holes (19) that the operator will place on one or several of the positioning means. These positioning means will comprise at least one but preferably two positioning studs (20) to be found at the filling station and/or welding station so as to provide excellent retention and total stability of pouches ($10_1$) during filling then welding operations and necessary, during identification by the affixing of a label to the pouch ($10_1$).

The filling and welding operations on a flexible pouch ($10_1$) are carried out in line and simultaneously so that the constant run-through of operations is not interrupted.

At the filling station there are various items the functions of which are closely interleaved with respect to one another. They are a mobile disposable filling needle (22) made of non-toxic semi-rigid plastic, a mobile NYLON needle guide (25) representing more particularly the guiding device of said needle (22), a metal sleeve (24) placed upstream of the needle guide (22) and which can be moved endwise with respect to the needle, and an inductive proximity detector (26).

The mobile filling needle (22) is in the retracted position to provide free movement of the roll of pouches (24) and is inserted manually in the filling channel (23) of pouch ($10_1$) by the operator.

Said filling needle (22) is inserted in needle guide (25) so as to be totally stable and therefore to remain constantly inserted between the two lips of the pouch film and also, constantly, in the filling axis.

Thanks to this concept, the roll of pouches (10) can be run in front of filling needle (22) and the filling channel of the pouch (23) can be offered up to the filling station thanks to the positioning studs (20) without the operator needing to move the filling needle (22) between the two lips of the pouch film ($10_1$).

The filling needle (22) and the needle guide (25) in which it is inserted (25) are both removable so that the operator may change the filling needle (22) whenever he proceeds with conditioning, in particular when using semen of different animals, and so that needle guide (25) may be cleaned or replaced thus eliminating any risk of mixing animal semen and therefore mixing animal breeds.

The needle guide (25) is attached in a movable manner to the block comprising an inductive proximity detector (26).

The metal sleeve (24) is inserted in needle guide (25) providing more particularly the connection and therefore the retention of feed pipe (12) and filler needle (22). For reasons similar to those explained above, as concerns filling needle (22) and needle guide (25), said metal sleeve (24) is also removable.

The inductive proximity detector (26) emits an alternating magnetic field triggering the welding of the flexible insemination pouches ($10_1$) that have previously been brought to the welding station by the operator, after the filling operation is over.

When the operator inserts the filling needle (22) in the filling channel (23) of the flexible pouch ($10_1$), provided for the purpose, the metal sleeve (24) is inserted into needle guide (25), cutting off the magnetic field emitted by inductive proximity detector (26), thus automatically triggering the welding of the pouch ($10_1$) brought in front of the welding station by the operator.

The simple movement of the mobile filling needle (22), inserted in pouch ($10_1$) to fill it, therefore controls the welding of the pouch which is at the welding station.

To control the volume of liquid to be injected into the pouch ($10_1$), a mobile volume calibration pallet (21) is retained on an arm attached to the lower edge of the invention.

During the filling operation, the liquid is allowed to flow by gravity between the two lips of the flexible pouch ($10_1$). It fills and its walls are pressed against the volume calibration pallet (21) providing for adjustment to within 2 ml of the desired volume of liquid, by controlling the space between the surface of tiltable table (1) and said pallet (21).

The operator moves the pouch manually to the second work-station, the welding station, and inserts one of the positioning holes (19) at the end of the pouch in the positioning stud (20) provided for the purpose to ensure total retention and also accurate positioning of the pouch ($10_1$) on the electrode controlling the weld.

The quality of the pulse weld involves some pressure on the weld line. This pressure will be controlled by the weight of the weighted welding mobile pallet (27) itself, connected on a hinge to the upper edge of table (1).

The mobility of welding pallet (27) allows the free circulation of empty or full pouches ($10_1$) and provides sufficient adjustable pressure to control the quality of the weld according to the thickness of the film forming the flexible pouch ($10_1$). This mobile welding pallet (27) includes a flat heating filament underneath an interchangeable strip of TEFLON provided with adhesive coating.

To provide a constant high quality weld line (28) through the filling channel (23) of pouch ($10_1$), the top of the film is clamped between an electrode and a counter-electrode.

The entire electrode system is supplied with 4 volt AC low voltage power.

This welding system prevents any degradation to the plastic film during welding and, in less than two seconds, provides for top quality welds.

The use of an electric pump is optional because the process described in this patent will allow the pouches to be filled by gravity.

Once the pouch has been welded, the operator will move it to the next work-station and will be able to proceed with labeling operations with manual printers of the IREX 2000 type in particular. Pouches ($10_1$) may be printed prior to filling because, when empty, they are easier to identify.

The straight edge of the table makes it easier to cut the pouches ($10_1$) to separate them from one another without using a pair of scissors.

This type of tiltable table (1) is specially designed for filling flexible pouches ($10_1$) but also offers the possibility of welding them and if necessary, identifying them by affixing a label to them so that the various work-stations can be coordinated harmoniously and efficiently, and also offers a simple and low cost design.

I claim:

1. A device for the packaging of liquids in flexible pouches designed for artificial insemination, the device comprising:

a table provided with means of support (9) at a tilt angle;

at least one positioning element (20) at least one of a filling and a welding station for positioning the pouches ($10_1$);

a needle guide (25) at the filling station for stabilizing a filling needle (22) so that it remains inserted between two lips of a film forming the pouches and aligned with a filling axis;

a volume calibration pallet (21); and a mobile weighted welding pallet (27) connected to an electric unit (2) for welding the pouches ($10_1$).

2. A device according to claim 1 wherein said means of support comprise two adjustable feet (9) located respectively at upper left and right ends of said table (1) for modifying the tilt angle to facilitate the filling of the pouches ($10_1$).

3. A device according to claim 2 wherein said adjustable feet (9) have suction devices for stabilizing said table.

4. A device according to claim 1 wherein said positioning element comprises at least one positioning stud.

5. A device according to claim 1 wherein said electric unit (2) comprises, an on/off switch (3), a time delay (4) for adjusting a welding time of the pouches ($10_1$), a potentiometer (5) for adjusting heating power, and a manual weld means (6).

6. A device according to claim 1 wherein said needle guide (25) is mobile and attached to a unit comprising an inductive proximity detector (26) for emitting an alternating magnetic field which cuts off automatically as soon as a metal sleeve (24) located upstream of needle guide (25) is inserted in said needle guide (25) after the insertion of said filling needle (22) in a pouch filling channel (23), thereby triggering the welding of the one of the pouches ($10_1$) at the welding station.

7. A device according to claim 1 wherein said needle guide (25) comprises NYLON and is connected to table (1) by removable attaching means.

8. A device according to claim 7 wherein said metal sleeve (24) is mobile and removable.

9. A device according to claim 1 wherein said volume calibration pallet (21) is attached to a lower edge of said table (1) to provide adjustment to within 2 ml of the desired volume of liquid.

10. A device according to claim 1, further comprising a graduation element (29) with a visual marker for determining a volume of the liquid in a one of the pouches at the filling station.

11. A device according to claim 1 wherein said welding pallet is mobile and connected to an upper edge of the table (1) by a hinge for applying sufficient pressure to control the weld according to the thickness of the film forming the pouches ($10_1$).

12. A device according to claim 11 wherein said welding pallet includes a flat heating filament located beneath an interchangeable non-stick strip.

13. A device according to claim 1, further comprising a boom (13) for supporting a container for the liquid.

* * * * *